United States Patent [19]

Cohodar

[11] Patent Number: 4,817,401

[45] Date of Patent: Apr. 4, 1989

[54] RETAINING BARRIER ASSEMBLY

[76] Inventor: Alija Cohodar, P.O. Box 380074, Miami, Fla. 33138

[21] Appl. No.: 59,098

[22] Filed: Jun. 8, 1987

[51] Int. Cl.[4] ..... E05B 73/00

[52] U.S. Cl. ..... 70/58; 70/234; 70/258; 49/463; 52/27; 52/173 R; 248/503; 248/553

[58] Field of Search ..... 70/15, 18, 234, 63, 70/57, 58, 258, 259; 248/552, 553; 40/50, 57; 109/10, 11, 14, 15, 48, 51, 52, 58; 52/204

[56] References Cited

U.S. PATENT DOCUMENTS

| | | | |
|---|---|---|---|
| 3,410,122 | 11/1968 | Moses | 70/58 |
| 3,498,400 | 3/1970 | Hysmith | 70/258 X |
| 3,595,041 | 7/1971 | Leeper | 70/58 X |
| 3,739,609 | 6/1973 | Kaufmann | 70/234 |
| 3,804,357 | 4/1974 | Robinett et al. | 70/58 X |
| 3,815,388 | 6/1974 | Nichol et al. | 70/63 |
| 3,837,545 | 9/1974 | Rogers, Jr. | 248/552 X |
| 4,028,913 | 6/1977 | Falk | 70/258 X |
| 4,038,843 | 8/1977 | Daley, Jr. | 70/58 |
| 4,081,978 | 4/1978 | Ivey | 248/553 X |
| 4,107,958 | 8/1978 | Manley, Jr, | 70/58 |
| 4,353,521 | 10/1982 | Webb | 70/58 X |
| 4,418,551 | 12/1983 | Kochackis | 70/18 |
| 4,453,692 | 6/1984 | LeDoux et al. | 70/58 X |
| 4,538,827 | 9/1985 | Pufka | 70/58 X |

*Primary Examiner*—Gary L. Smith
*Assistant Examiner*—Suzanne L. Dino
*Attorney, Agent, or Firm*—John Cyril Malloy

[57] ABSTRACT

A retaining barrier designed specifically to prevent unauthorized removal or stealing of a variety of objects from their intended mounted position within a supporting structure. The object may be an air conditioning assembly of the type found in conventional motel/hotel buildings, and being of the single-room air conditioner type mounted in a building wall and having one exterior face exposed to atmosphere on the exterior of the building and one interior face delivering conditioned air to a room or rooms on the interior of the building. A brace assembly includes both an exterior and an interior brace element disposed in overlying and substantially covering relation to respectively positioned faces of the object so as to restrict unauthorized removal of the object or air conditioning assembly from the supporting building wall.

8 Claims, 2 Drawing Sheets

RETAINING BARRIER ASSEMBLY

BACKGROUND OF THE INVENTION

1. Field of the Invention

The present invention relates to a combined retaining and barrier assembly fixedly secured to a wall or any of a variety of other mounted structures and overlying, in a retaining manner, one or more exposed surfaces or faces of the object being retained so as to prevent or make exceedingly more difficult the unauthorized removal of the object from its intended mounting support.

2. Description of the Prior Art

Numerous objects, products, etc. are installed or supported on a mounting structure during normal intended operation thereof, wherein unauthorized removal of such objects is relatively easy resulting in frequent theft thereof. By way of example, many motel/hotel building structures incorporate individual room air conditioners specifically mounted in the building wall in a manner which positions the exterior face or surface of the air conditioner on the exterior of the building and an interior face of the air conditioner on the interior of the room so as to deliver conditioned air thereto.

Since these air conditioning units are mounted directly in the wall, in exposed relation to the exterior of the building, it is a relatively easy matter to remove the entire air conditioning unit from the wall aperture in which it is mounted without the knowledge of the building proprietor. This, of course, results in theft of many air conditioning units.

Similarly, other objects including but not limited to automobile batteries, and like products, which are mounted in what may be referred to as a generally exposed or accessible position, are frequently stolen for the same reasons. In an attempt to overcome such disadvantages and prevent unauthorized removal of exposed products, objects, etc., the prior art has included numerous retaining or barrier structures of the type evidenced in the following U.S. Pat. Nos.: 4,038,843; 4,028,913; 3,918,599; 3,595,041; and 3,104,860.

While operable for their intended function, many of the structures set forth above are not readily adaptable for the retention and protection of products or objects which are intended to be "permanently installed" such as air conditioning units of the type described above.

Accordingly, there is a need for a combination barrier, retainer assembly which specifically prevents unauthorized removal of products, objects, etc. of the type which are permanently or removably mounted or installed at a given intended operable location wherein a minimal amount of modification need be done to the mounting structure in order to install the subject retaining barrier assembly in a manner which will restrict and make increasingly difficult unauthorized removal of the protected object or product.

SUMMARY OF THE INVENTION

The present invention relates to a retaining barrier assembly of the type designed to "protect" various objects and products from unauthorized removal from their intended mounting or a support structure or the like. The present invention is herein described being primarily directed to the retention and protection of a product, such as a room-type air conditioner mounted in the building wall so as to be concurrently exposed both to the exterior and interior of the building. It should be noted that the barrier assembly of the present invention is adaptable for use with a variety of other types of products and is not to be considered limited to the protection of an air conditioning unit.

The subject barrier assembly comprises an exterior brace element having an elongated configuration sufficient to extend across the exposed exterior face of a product, such as an air conditioner or the like. Opposite ends of the exterior brace element are anchored to the mounting structure in the form of a wall of a building in which the air conditioning unit is mounted. Similarly, the subject invention includes an interior brace element also preferably having an elongated configuration of sufficient length to extend across in overlying relation to an interior face or surface of the air conditioning unit.

An anchoring means is provided which comprises two anchoring sleeves extending through the supporting wall and accessible from both the exterior and interior surfaces thereof. A first portion of the anchoring means extends out from one of the anchoring sleeves so as to allow connection therewith with one end of the interior brace element. The opposite end of the interior brace element is removably or pivotally connected to a second portion of the anchoring means extending out from the interior wall of the building from the other on of the anchoring sleeves. Because of the movable interconnection of the interior brace element, it may be selectively positioned between an open and closed position wherein the open position is defined by placement of the interior brace element out of overlying relation to the interior face of the air conditioning unit so as to provide access thereto or allow the authorized removal thereof for purposes of maintenance, placement or repair.

The subject invention further includes supplementary brace element which may be fixedly secured such as by welding or an integral construction, in a transverse orientation to each of the exterior and interior brace elements. Opposite ends of each of the supplementary brace elements are affixed to or otherwise anchored into the supporting wall. By virtue of this structural configuration, both the exterior and interior brace elements include a supplementary brace element and together a transversely oriented brace assembly is disposed in overlying and covering relation to both the exterior and interior faces or surfaces of the object, such as an air conditioner, mounted in a building wall.

It should be noted and emphasized that dependent upon the particular object or product being retained, the subject retaining brace assembly may vary in configuration as well as its attachment to or structure of the anchoring means associated with the subject retaining brace assembly and serving to secure it to the mounting structure on which the product or object being retained is secured.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a full understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
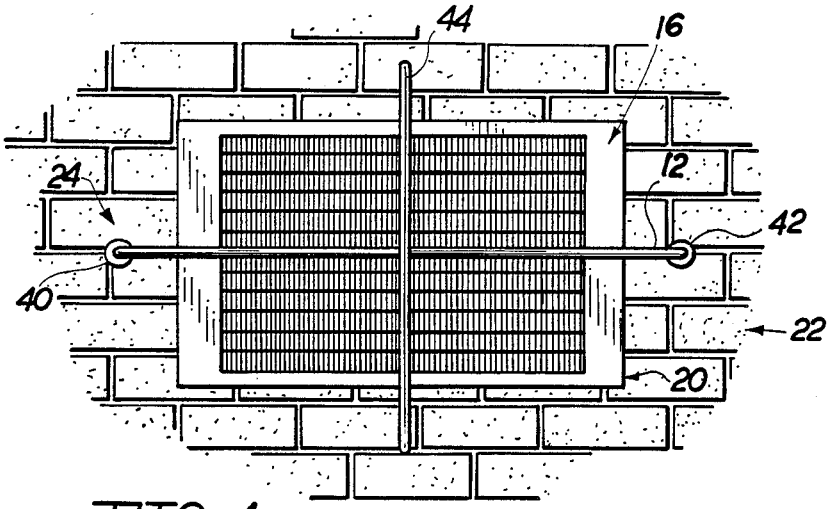
FIG. 1 is a front plan view of the retaining barrier assembly of the present invention secured to an object such as an air conditioner mounted in a building wall.

As shown in FIGS. 1 through 4, a preferred embodiment of the present invention of the subject retaining barrier assembly is generally indicated as 10 and comprises an exterior brace element 12 (FIG. 1) and an interior brace element 14 (FIG. 2) both having an elongated configuration of sufficient dimension to extend across in overlying relation to an exterior face 16 and an interior face 18, respectively, of an air conditioning unit 20. The air conditioning unit 20 is representative of a large variety of products or objects which can be retained and therefore protected by the barrier assembly 10 of the present invention. Further, the air conditioning unit 20 is of the type to be mounted in a building wall 22 such that the exterior surface 16 is exposed directly to the outside of the building wall 22 and further wherein the interior surface 18 is exposed to the room interior so as to direct conditioned air thereto.

The exterior brace assembly 12 has opposite ends as at 15 and 17 integrally formed thereon and extending inwardly into the wall 22 so as to be fixedly anchored therein by the existence of an anchoring means generally indicated as 24. The anchoring means, to be described in greater detail hereinafter, comprises a multicomponent structure serving to secure or "anchor" the interior and exterior brace elements 12 and 14, respectively, to the wall 22 in a manner which will retain and therefore protect the air conditioning assembly 20 in its intended installed and operative position within the wall structure 22 serving as the mounting structure for the air conditioning unit 20.

Figure 2:
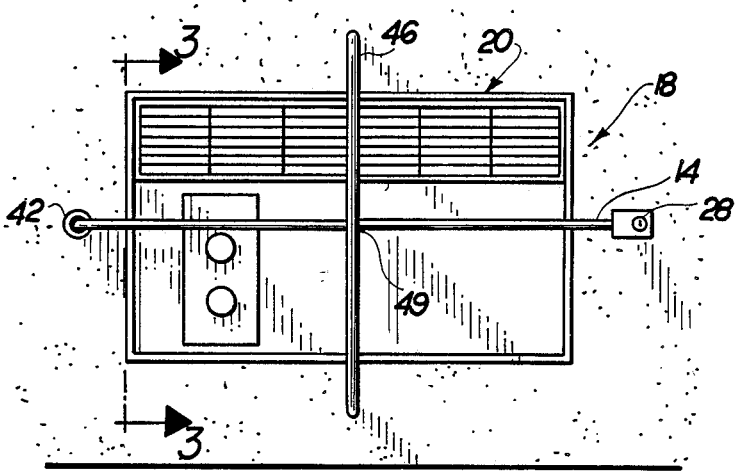
FIG. 2 is a front plan view of an interior view of the embodiment of FIG. 1.
Figure 3:
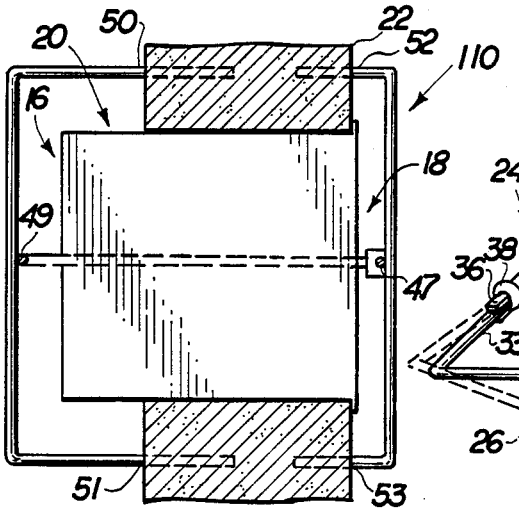
FIG. 3 is a sectional view in partial cut-away along line 3—3 of FIG. 2.
Figure 4:
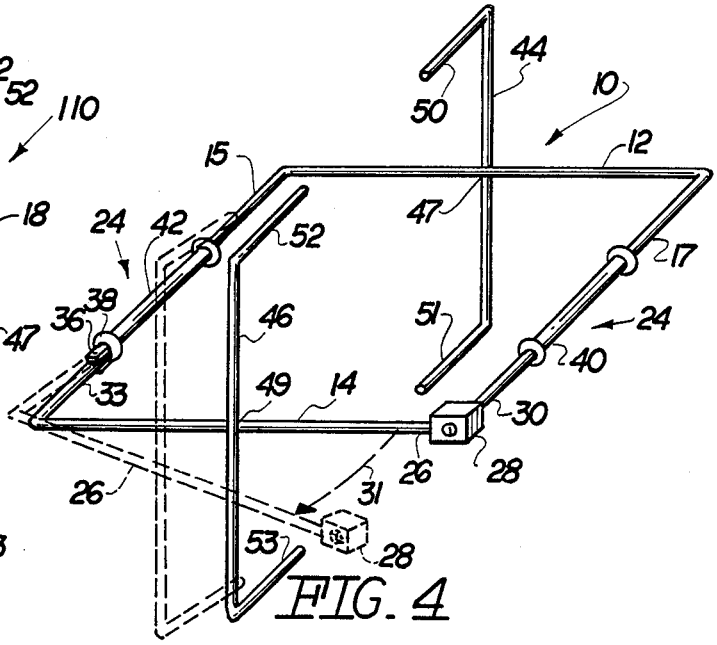
FIG. 4 is a perspective view of the barrier assembly of the embodiment of FIGS. 1 through 3 with an interior brace element thereof shown in an open position as represented in phantom lines.

The interior brace element 14 has a first end as at 26 cooperatively connected to or supporting a lock means 28. The lock means is of the type to allow removable securement of the interior brace element 14 to a first portion 30 of the anchoring means 24. Further, the lock means 28 may be operated by a key member (not shown) or any applicable latch which serves to fixedly secure the interior brace element 14 in a closed position as represented in FIGS. 2, 3 and 4, or upon disconnection thereof with first portion 30 of the anchoring means 24, allow the interior brace element 14 to be removed to an open position as represented in phantom lines in FIG. 4 and also by directional arrow 31. Such movement of the brace element 14 between its closed position and open position is accomplished by the second end 33 being movably or pivotally connected as at 36 to a second portion 38 of the anchoring means (see FIG. 4).

As set forth above, the anchoring means 24 also comprises two anchoring sleeves 40 and 42 rotatably mounted in surrounding relation to appropriate ends of the exterior and interior brace elements 12 and 14, as clearly shown in FIG. 4. Such rotational movement relative to the correspondingly positioned ends of the brace elements prevents an unauthorized person from attempting threaded disconnection of the sleeves 40 and 42 from the appropriately positioned ends through the use of any conventional tooling or the like.

As can be seen in FIGS. 1 and 2, the sleeves 40 and 42 are disposed to protrude from the opposite exterior and interior surfaces of the wall 22 in a manner which facilitates interconnection of the appropriate ends of both the exterior and interior brace elements 12 and 14, respectively.

Yet another feature of the present invention is the existence of supplementary brace elements 44 and 46, respectively connected to the exterior brace element 12 and the interior brace element 14. Such fixed interconnection of the supplementary brace elements to the appropriately positioned exterior or interior brace elements is accomplished as by welding or an integral construction at the junction thereof 47 and 49. Further, the opposite ends 50, 51 and 52, 53 each extend inwardly into an anchored and fixed engagement with the wall 22 as best shown in FIG. 3. Accordingly, as clearly shown in FIGS. 1 through 4, the transverse brace elements 12, 44 and 14, 49 specifically overly and effectively cover the exterior and interior surfaces 16 and 18 of an object being retained such as air conditioning unit 20 in a manner which restricts and makes infinitely move difficult the unauthorized removal of such air conditioning unit 20 from its mounting structure or wall 22.

Figure 5:
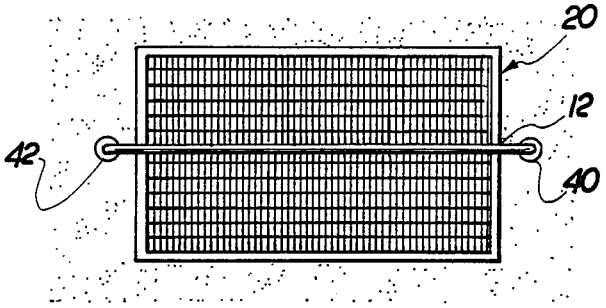
FIG. 5 is a front plan view of another embodiment of the present invention showing an exterior surface thereof.
Figure 6:
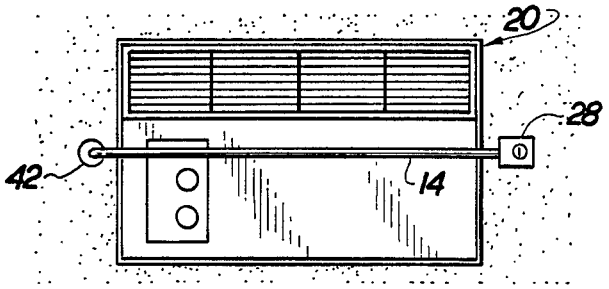
FIG. 6 is a front plan view of the embodiment of FIG. 5 showing the interior surface thereof.

With reference to FIGS. 5 and 6, another embodiment of the present invention comprises the exterior and interior brace elements 12 and 14 being used independent of any transversely oriented and fixedly attached supplementary brace elements such as 44 and 46 shown in the embodiment of FIG. 4.

Suffice it to say that dependent upon the size and disposition of the object 20 (air conditioning unit) a single interior or exterior brace element 12 or 14, respectively, is applicable to retain, support and thereby protect the air conditioning unit 20 from unauthorized removal from its supporting wall structure.

Figure 7:
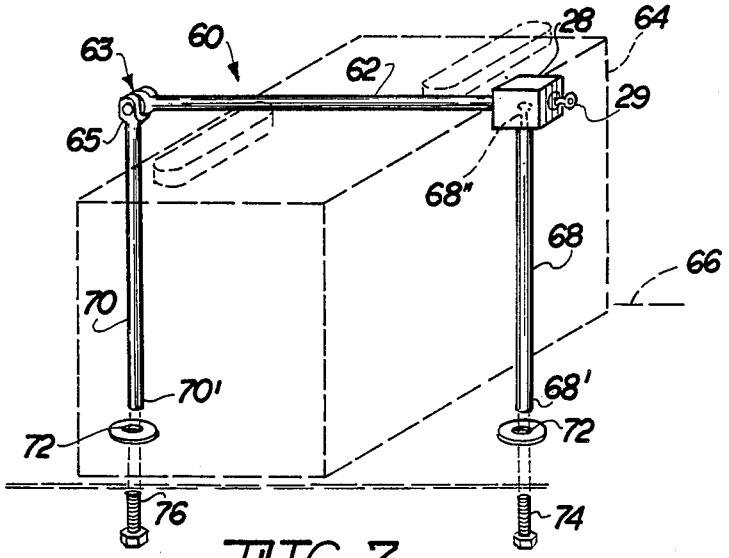
FIG. 7 is a perspective view in partial phantom lines of yet another embodiment of the present invention.

Yet another embodiment of the present invention is shown in FIG. 7 and is generally represented as 60 wherein a first brace element 62 has an elongated configuration of sufficient length to extend in transverse relation over a top portion of an object being retained such as a storage battery used for automobile, marine craft, etc. The storage battery 64 is represented in phantom lines and shown supported on a mounting structure 66 in the form of a supporting platform.

The brace assembly 60 further includes a first arm 68 and a second arm 70 disposed in spaced apart relation to one another substantially equal to the length of the first brace element 62 wherein the arms 68 and 70 are disposed on opposite sides of the storage battery 64.

Distal ends as at 68′ and 70′ are secured to the mounting structure 66 by means of appropriately positioned aperture 72 formed in the mounting structure 66. The aperture 72 is sufficiently dimensioned to receive the appropriate ends 68′ and 70′ and such ends may be bored or hollow and include an internal threading structure to receive the threaded connectors 74 and 76 as clearly shown in figure 7.

A lock assembly 28 having an operative key 29 may be affixed to one end of the brace element 62 and positioned for mating engagement with a proximal end 68" of the one arm 68. The opposite end of brace element 62 as at 63 is movably connected to a hand or like structure 65 thereby allowing its movement relative thereto and facilitate selective positioning of the brace element 62 between the closed position shown in FIG. 7 and an open position (not shown for purposes of clarity but clearly evident by the structure represented in FIG. 7).

Now that the invention has been described,

What is claimed is:

1. A retaining barrier assembly used in combination with a wall having an interior exposed surface and an exterior exposed surface and designed to restrict unauthorized removal of an object from either the interior or exterior surfaces of the wall when the object is mounted in an aperture formed in the wall, said assembly comprising:

(a) an exterior brace element having an elongated configuration and made of rigid, high strength material and having opposite ends secured to the wall adjacent the aperture, said external brace element extending outwardly from the exterior surface of the wall and across and in overlying relation to an exteriorly disposed face of the object, (b) an interior brace element having an elongated configuration and made of rigid, high strength material and having opposite ends secured to the wall adjacent the aperture, said interior brace element extending outwardly from the interior surface of the wall and extending in overlying relation to the internal face of the object, (c) anchor means mounted in said wall on opposite sides of the aperture and in spaced, substantially adjacent relation thereto and extending through the wall in an exposed relation to both of the exterior and interior surfaces thereof for interconnection and anchoring of correspondingly positioned ends of said exterior and interior brace elements to one another and the wall, (d) said interior brace element comprising a first end removably attached to said anchor means and the wall and a second end movably connected to said anchor means and movable between an open and a closed position, (e) said open position defined by disposition of said interior brace element out of overlying relation to the interior face of the object to provide access thereto and removal of the object from the wall, (f) said anchoring means comprising at least one sleeve member rotatably mounted relative to and in surrounding relation about at least one pair of correspondingly positioned connected ends of said interior and exterior brace elements, whereby unauthorized disconnection of the anchoring sleeve from said brace element is restricted.

2. An assembly as in claim 1 further comprising a locking means disposed in interconnecting relation between said first end and said anchoring means for securing said brace element thereto.

3. An assembly as in claim 2 wherein said lock means comprise a lock assembly secured to said one end or an outer extremity of said first portion in removably attachable and locking engagement with the other of said one end or outer extremity of said first portion.

4. An assembly as in claim 1 wherein said anchoring means comprises two sleeve members each rotatably mounted in surrounding relation to a separate one of said opposite ends of said exterior brace elements.

5. An assembly as in claim 4 wherein the mounting structure comprises a building wall and said anchoring sleeves extend therethrough to extend outwardly from opposite surfaces of the building wall, both said exterior and interior brace elements attached to one another by said anchor sleeve; said exterior and said interior brace elements disposed in overlying relation to opposite faces of the product and exterior and interior surfaces of the building.

6. An assembly as in claim 1 further comprising a supplementary brace element fixedly secured to one of said interior or exterior brace elements and disposed in transverse orientation thereto and in covering, overlying relation to a correspondingly positioned face of the object.

7. An assembly as in claim 1 further comprising a first and a second supplementary brace element fixedly secured to said exterior and said interior brace element, respectively, and oriented in transverse relation thereto and in covering relation to respective faces of the object.

8. An assembly as in claim 7 wherein each of said first and second supplementary brace elements comprise opposite longitudinal ends secured to the mounting structure.

* * * * *